US007730741B2

(12) United States Patent
Sakitani et al.

(10) Patent No.: US 7,730,741 B2
(45) Date of Patent: Jun. 8, 2010

(54) REFRIGERATION APPARATUS WITH EXPANDER CONTROL FOR IMPROVED COEFFICIENT OF PERFORMANCE

(75) Inventors: Katsumi Sakitani, Osaka (JP); Michio Moriwaki, Osaka (JP); Yume Inokuchi, Osaka (JP); Yoshinari Sasaki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 607 days.

(21) Appl. No.: 11/631,674

(22) PCT Filed: Jul. 1, 2005

(86) PCT No.: PCT/JP2005/012219

§ 371 (c)(1),
(2), (4) Date: Jan. 5, 2007

(87) PCT Pub. No.: WO2006/004047

PCT Pub. Date: Jan. 12, 2006

(65) Prior Publication Data

US 2007/0251245 A1 Nov. 1, 2007

(30) Foreign Application Priority Data

Jul. 7, 2004 (JP) ..... 2004-200987

(51) Int. Cl.

| | |
|---|---|
| ***F25B 1/06*** | (2006.01) |
| ***F25B 9/00*** | (2006.01) |
| ***F25B 19/02*** | (2006.01) |
| ***F25B 41/00*** | (2006.01) |
| ***F25B 41/04*** | (2006.01) |

(52) U.S. Cl. ..... 62/500; 62/87; 62/170; 62/197; 62/222

(58) Field of Classification Search ..... 62/500, 62/87, 222, 197, 170, 324.6
See application file for complete search history.

(56) References Cited

U.S. PATENT DOCUMENTS

| | | | | |
|---|---|---|---|---|
| 6,202,416 | B1 * | 3/2001 | Gray, Jr. | 60/620 |
| 6,880,357 | B2 * | 4/2005 | Nakatani et al. | 62/324.6 |
| 2004/0083751 | A1 | 5/2004 | Nakatani et al. | |
| 2004/0118138 | A1 * | 6/2004 | Nakatani et al. | 62/197 |

FOREIGN PATENT DOCUMENTS

| | | | |
|---|---|---|---|
| EP | 1 416 231 | A1 | 5/2004 |
| JP | 2001-116371 | A | 4/2001 |
| JP | 2004-60989 | A | 2/2004 |
| JP | 2004-108683 | A | 4/2004 |
| JP | 2004-150748 | A | 5/2004 |

* cited by examiner

*Primary Examiner*—Frantz F. Jules
*Assistant Examiner*—Travis Ruby
(74) *Attorney, Agent, or Firm*—Birch, Stewart, Kolasch & Birch, LLP

(57) ABSTRACT

An outdoor heat exchanger (23), an indoor heat exchanger (24), a compression/expansion unit (30), and other circuit components are connected in a refrigerant circuit (20). The compression/expansion unit (30) includes a compression mechanism (50), an electric motor (45), and an expansion mechanism (60). In addition, the refrigerant circuit (20) has an injection pipeline (26). When an injection valve (27) is opened, a portion of high pressure refrigerant after heat dissipation flows into the injection pipeline (26) and is introduced into an expansion chamber (66) of the expansion mechanism (60) in the process of expansion. In the expansion mechanism (60), power is recovered from both high pressure refrigerant introduced into the expansion chamber (66) from an inflow port (34) and high pressure refrigerant introduced into the expansion chamber (66) from the injection pipeline (26).

13 Claims, 9 Drawing Sheets

REFRIGERATION APPARATUS WITH EXPANDER CONTROL FOR IMPROVED COEFFICIENT OF PERFORMANCE

TECHNICAL FIELD

The present invention relates to a refrigeration apparatus which includes an expander and which performs a refrigeration cycle.

BACKGROUND ART

Refrigeration apparatuses operable to perform a refrigeration cycle are well known in the conventional technology. Such a type of refrigeration apparatus has a variety of applications, for example, in the field of air conditioners. Patent Document I discloses a refrigeration apparatus of the type which includes an expander. In the refrigeration apparatus disclosed in Patent Document I, the expander is connected, through a single shaft, to a compressor. In the refrigeration apparatus of Patent Document I, high pressure refrigerant after heat dissipation is expanded in the expander for the recovery of power. The power recovered in the expander is used to drive the compressor, with a view to achieving improvement in the coefficient of performance (COP).

In a typical refrigeration apparatus, refrigerant is circulated in a refrigerant circuit configured in the form of a closed circuit. This produces the necessity of constantly keeping the mass flow rate of refrigerant through the expander and the mass flow rate of refrigerant through the compressor at the same value. However, the refrigeration apparatus, when in operation, undergoes variations in the operating condition (e.g., the variation in the high pressure of the refrigeration cycle and the variation in the low pressure of the refrigeration cycle). In consequence, the density of refrigerant that flows into the compressor and the compressor will vary. If, like Patent Document I, the expander is coupled to the compressor by a single shaft, the rotation speed of the expander and the rotation speed of the compressor constantly become equal. Therefore, if both the expander and the compressor are implemented by positive displacement fluid machines, this results in occurrence of an imbalance between the mass flow rate of refrigerant through the expander and the mass flow rate of refrigerant through the compressor. This might make it impossible for the refrigeration apparatus to continuously perform a stable refrigerant cycle.

On the other hand, in the refrigeration apparatus of Patent Document I, a bypass passageway is provided in parallel with the expander and a flow rate control valve is arranged along the bypass passageway. When the mass flow rate of refrigerant passable through the expander becomes excessively small relative to the mass flow rate of refrigerant through the compressor, the refrigerant is made to flow through both the expander and the bypass passageway.

Patent Document I: JP 2001-116371A

DISCLOSURE OF THE INVENTION

Problems that the Invention Intends to Solve

If, as described above, the refrigerant circuit is provided with a bypass passageway which bypasses the expander for the introducing of refrigerant into the expander as well as the bypass passageway, this enables the refrigeration apparatus to operate stably even when the mass flow rate of refrigerant passable through the expander becomes small relative to the mass flow rate of refrigerant through the compressor. However, the problem with this arrangement is that, if the refrigerant is made to flow into the bypass passageway as described above, the amount of refrigerant that flows through the expander is reduced by an amount corresponding to the amount of refrigerant that flows into the bypass passageway. Consequently, the amount of power recoverable from the refrigerant in the expander is reduced. This might result in an increase in the amount of electric power to be supplied from the outside for driving the compressor.

With the above problems in mind, the present invention was made. Accordingly, an object of the present invention is to provide an improved refrigeration apparatus capable of stable operation in a variety of operating conditions while suppressing the reduction in the amount of power recoverable from the refrigerant in the expander to the minimum.

Means for Solving the Problems

The present invention provides, as a first aspect, a refrigeration apparatus comprising a refrigerant circuit (20), along which a compressor (50), a heat dissipator, an expander (60), and an evaporator are connected, for performing a refrigeration cycle by circulating a refrigerant in the refrigerant circuit (20). The refrigeration apparatus of the first aspect of the present invention comprises (a) an injection passageway (26) through which a portion of the refrigerant flowing towards the expander (60) from the heat dissipator in the refrigerant circuit (20) is introduced into an expansion chamber (66) of the expander (60) in the process of expansion and (b) a flow rate control valve (27) for regulating the refrigerant flow rate in the injection passageway (26).

The present invention provides, as a second aspect according to the first aspect, a refrigeration apparatus which comprises a controller means (90) for adjusting the position of the flow rate control valve (27) so that the coefficient of performance of the refrigeration cycle in the refrigerant circuit (20) reaches a maximum value available in a current operating condition of the refrigeration apparatus.

The present invention provides, as a third aspect according to the second aspect, a refrigeration apparatus wherein the controller means (90) is configured to derive, based on an actually measured value indicative of an operating condition of the refrigeration apparatus, a high pressure of the refrigeration cycle which maximizes the coefficient of performance of the refrigeration cycle as a control target value and adjust the position of the flow rate control valve (27) so that the derived high pressure of the refrigeration cycle becomes the control target value.

The present invention provides, as a fourth aspect according to the second aspect, a refrigeration apparatus wherein the controller means (90) is configured to derive, based on a variation in the coefficient of performance of the refrigeration cycle occurring when the high pressure of the refrigeration cycle is increased or decreased, a high pressure of the refrigeration cycle which maximizes the coefficient of performance of the refrigeration cycle as a control target value and adjust the position of the flow rate control valve (27) so that the derived high pressure of the refrigeration cycle becomes the control target value.

The present invention provides, as a fifth aspect according to any one of the second to fourth aspects, a refrigeration apparatus wherein: (a) the refrigerant circuit (20) includes a bypass passageway (28) for connecting upstream and downstream sides of the expander (60) and a bypass control valve (29) for regulating the refrigerant flow rate in the bypass passageway (28); and (b) the controller means (90) is configured to perform a primary control operation and an auxiliary control operation in the former of which the position of the flow rate control valve (27) is adjusted with the bypass control valve (29) held in the fully closed state and in the latter of which the position of the bypass control valve (29) is adjusted with the flow rate control valve (27) held in the fully opened state when the flow rate control valve (27) enters the fully opened state during the primary control operation, thereby resuming the primary control operation when the bypass control valve (29) enters the fully closed state during the auxiliary control operation.

The present invention provides, as a sixth aspect according to the fifth aspect, a refrigeration apparatus wherein the controller means (90) is configured to derive, based on an actually measured value indicative of an operating condition of the refrigeration apparatus, a high pressure of the refrigeration cycle which maximizes the coefficient of performance of the refrigeration cycle as a control target value and perform, as the auxiliary control operation, an operation in which the position of the bypass control valve (29) is adjusted so that the derived high pressure of the refrigeration cycle becomes the control target value.

The present invention provides, as a seventh aspect according to the fifth aspect, a refrigeration apparatus wherein the controller means (90) is configured to derive, based on a variation in the coefficient of performance of the refrigeration cycle occurring when the high pressure of the refrigeration cycle is increased or decreased, a high pressure of the refrigeration cycle which maximizes the coefficient of performance of the refrigeration cycle as a control target value and perform, as the auxiliary control operation, an operation in which the position of the flow rate control valve (27) is adjusted so that the derived high pressure of the refrigeration cycle becomes the control target value.

The present invention provides, as an eighth aspect according to any one of the first to seventh aspects, a refrigeration apparatus wherein the refrigerant circuit (20) is charged with carbon dioxide as a refrigerant and the high pressure of the refrigeration cycle performed in the refrigerant circuit (20) is set equal to or above the critical pressure of carbon dioxide.

Working of the Invention

In the first aspect of the present invention, the refrigeration cycle is performed in the refrigerant circuit (20). In the refrigerant circuit (20), the refrigerant discharged out of the compressor (50) dissipates heat in the heat dissipator and is reduced in pressure in the expander (60). Subsequently, the refrigerant is caused to evaporate in the evaporator and is then drawn into the compressor (50) where it is compressed. The high pressure refrigerant after heat dissipation in the heat dissipator is expanded in the expander (60) and power is recovered from the high pressure refrigerant. The power recovered from the refrigerant in the expander (60) is used to drive the compressor (50). If there is created an imbalance between the amount of refrigerant that flows through the expander (60) and the amount of refrigerant that flows through the compressor (50), the refrigerant is introduced into the expansion chamber (66) of the expander (60) also from the injection passageway (26). The refrigerant thus introduced into the expansion chamber (66) from the injection passageway (26) is expanded together with the refrigerant introduced into the expansion chamber (66) of the expander (60) from the inflow port. In addition, the refrigerant flow rate through the injection passageway (26) can be changed by shifting the position of the flow rate control valve (27).

In the second aspect of the present invention, the controller means (90) for controlling the position of the flow rate control valve (27) is provided in the refrigeration apparatus (10). In the refrigerant circuit (20) of the second aspect of the present invention, if the amount of refrigerant that is introduced into the expander (60) from the injection passageway (26) is changed, this causes, for example, the high pressure of the refrigeration cycle to vary, in consequence of which the coefficient of performance of the refrigeration cycle will vary as well. Therefore, the controller means (90) of the second aspect of the present invention adjusts the position of the flow rate control valve (27) so that the coefficient of performance of the refrigeration cycle in the refrigerant circuit (20) reaches a maximum value available in a current operating condition of the refrigeration apparatus (10).

In the third aspect of the present invention, the controller means (90) sets a control target value for the high pressure of the refrigeration cycle. In this setting, the controller means (90) derives, based on an actually measured value indicative of an operating condition of the refrigeration apparatus, a value of the high pressure of the refrigerant cycle which maximizes the coefficient of performance of the refrigeration cycle in the operating condition and the derived value becomes the control target value. The controller means (90) then adjusts the position of the flow rate control valve (27) so that the actual high pressure of the refrigeration cycle becomes the control target value.

In the fourth aspect of the present invention, the controller means (90) sets a control target value for the high pressure of the refrigeration cycle. In this setting, in order to set such a control target value, the controller means (90) first performs an operation of experimentally increasing or decreasing the high pressure of the refrigeration cycle. As the high pressure of the refrigeration cycle is varied, the coefficient of performance of the refrigeration cycle varies as well. Based on that variation in the coefficient of performance, the controller means (90) derives a value of the high pressure of the refrigeration cycle which provides a maximum coefficient of performance and the derived value serves as the control target value. The controller means (90) then adjusts the position of the flow rate control valve (27) so that the actual high pressure of the refrigeration cycle becomes the control target value.

In the fifth aspect of the present invention, the bypass passageway (28) and the bypass control valve (29) are arranged along the refrigerant circuit (20). In the opened state of the bypass control value (29), a portion of the refrigerant after heat dissipation in the heat dissipator enters the bypass passageway (28) while the other refrigerant is delivered to the expander (60). In addition, a portion of the refrigerant that is delivered to the expander (60) is introduced directly to the inflow port of the expander (60) and the other refrigerant is introduced, through the injection passageway (26), into the expansion chamber (66) of the expander (60). On the other hand, the refrigerant which has entered the bypass passageway (28) is reduced in pressure during its passage through the bypass control valve (29), joins the refrigerant which has passed through the expander (60), and is delivered to the evaporator.

In this aspect of the present invention, the controller means (90) performs two operations, i.e., the primary control operation and the auxiliary control operation. The controller means (90) in the primary control operation adjusts the position of the flow rate control valve (27), with the bypass control valve (29) having entered the fully closed state, thereby regulating the refrigerant flow rate in the injection passageway (26). When the flow rate control valve (27) enters the fully opened state during the primary control operation, i.e., when entering a state in which the refrigerant flow rate in the injection passageway (26) cannot be increased any more, the controller means (90) commences the auxiliary control operation. The controller means (90) in the auxiliary control operation adjusts the position of the bypass control valve (29) with the flow rate control valve (27) being in the fully opened state, thereby regulating the refrigerant flow rate in the bypass passageway (28). When the bypass control valve (29) enters the fully closed state during the auxiliary control operation, i.e., when entering a state in which the distribution of refrigerant in the bypass passageway (28) is no longer required, the controller means (90) commences the primary control operation.

In the sixth aspect of the present invention, the controller means (90) in the auxiliary control operation sets a control target value for the high pressure of the refrigeration cycle. In this setting, the controller means (90) derives, based on an actually measured value indicative of an operating condition of the refrigeration apparatus, a value of the high pressure of the refrigeration cycle which maximizes the coefficient of performance in that operating condition, and the derived value serves as the control target value. And, the controller means (90) in the auxiliary control operation adjusts the position of the bypass control valve (29), with the flow rate control valve (27) of the injection passageway (26) held in the fully opened state, and the actual high pressure of the refrigeration cycle becomes the control target value.

In the seventh aspect of the present invention, the controller means (90) in the auxiliary control operation sets a control target value for the high pressure of the refrigeration cycle. In this setting, in order to set such a control target value, the controller means (90) performs an operation of experimentally increasing or decreasing the high pressure of the refrigeration cycle. As the high pressure of the refrigeration cycle is varied, the coefficient of performance of the refrigeration cycle varies as well. Based on that variation in the coefficient of performance, the controller means (90) derives a value of the high pressure of the refrigeration cycle which provides a maximum coefficient of performance, and the derived value serves as the control target value. And, the controller means (90) in the auxiliary control operation adjusts the position of the bypass control valve (29), with the flow rate control valve (27) of the injection passageway (26) held in the fully opened state, and the actual high pressure of the refrigeration cycle becomes the control target value.

In the eighth aspect of the present invention, the refrigerant circuit (20) is charged with carbon dioxide as a refrigerant. In the refrigerant circuit (20), the charged carbon dioxide as a refrigerant is circulated to thereby perform a refrigeration cycle, during which cycle, in the compressor (50) of the refrigerant circuit (20), the charged carbon dioxide as a refrigerant is compressed above its critical pressure.

Advantageous Effects of the Invention

Even when the refrigeration apparatus (10) of the first aspect of the present invention enters a state which creates an imbalance between the amount of refrigerant that flows through the expander (60) and the amount of refrigerant that flows through the compressor (50), the expander (60) and the compressor (50) can be balanced with each other in the amount of passing refrigerant by refrigerant introduction into the expander (60) also from the injection passageway (26). Therefore, the refrigerant conventionally made to bypass the expander (60) will now be allowed to be introduced into the expander (60), and power can be recovered also from the refrigerant from which power cannot conventionally be recovered. Therefore, in accordance with the first aspect of the present invention, it becomes possible to realize the refrigeration apparatus (10) capable of stable operation in a variety of operating conditions without hardly reducing the amount of power recoverable from the refrigerant.

In the second aspect of the present invention, the controller means (90) adjusts the position of the flow rate control valve (27) so as to provide a maximum coefficient of performance. Therefore, in accordance with the second aspect of the present invention, the expander (60) and the compressor (50) are balanced with each other in the amount of passing refrigerant so that the refrigeration cycle is stably continuously performed and, in addition, the refrigeration cycle can be performed in a condition that accomplishes a maximum coefficient of performance.

In the fifth aspect of the present invention, the refrigerant circuit (20) includes the bypass passageway (28), thereby making it possible to deliver the outflow of refrigerant from the heat dissipator to the evaporator through both the expander (60) and the bypass passageway (28). Therefore, even when the expander (60) and the compressor (50) cannot be balanced with each other in the amount of passing refrigerant by refrigerant introduction into the expander (60) from the injection passageway (26), it becomes possible to secure an amount of refrigerant that circulates in the refrigerant circuit (20) by causing the refrigerant to flow through the bypass passageway (28). In addition, the controller means (90) of the fifth aspect of the present invention opens the bypass control valve (29) only when the flow rate control valve (27) of the injection passageway (26) is fully opened. As a result of such arrangement, it becomes possible to suppress the refrigerant flow rate in the bypass passageway (28) to the minimum necessary, thereby securing the amount of refrigerant that flows through the expander (60) to the full, and the degree of reduction in the amount of power recoverable from the refrigerant in the expander (60) can be kept to the minimum.

REFERENCE NUMERALS IN THE DRAWINGS

Figure 1:
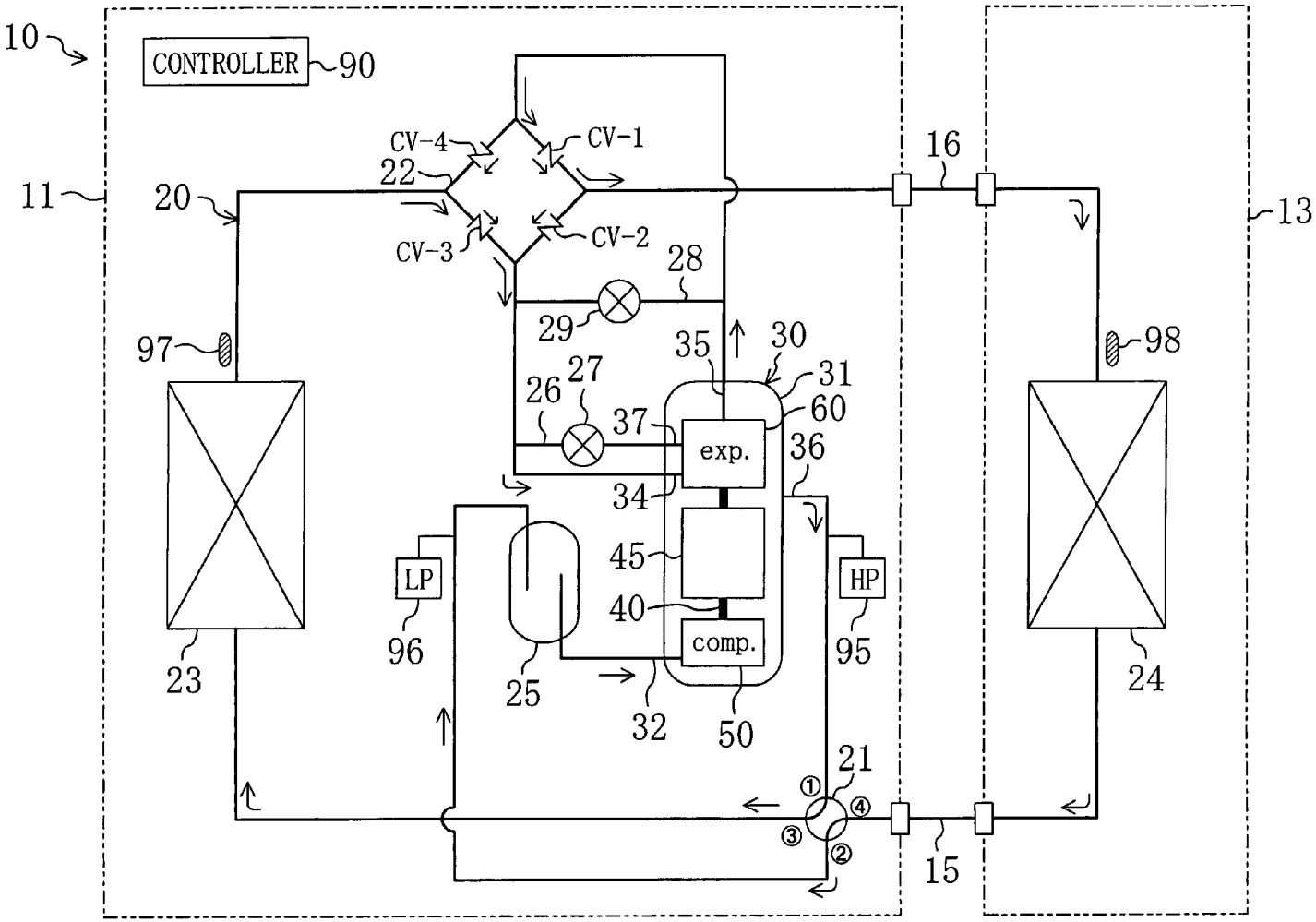
FIG. 1 is a schematic block diagram which shows the configuration of an air conditioner and an operation in the cooling mode.

10: refrigeration apparatus
20: refrigerant circuit
23: outdoor heat exchanger
24: indoor heat exchanger
26: injection pipeline (injection passageway)
27: injection valve (flow rate control valve)
28: bypass pipeline (bypass passageway)
29: bypass valve (bypass control valve)
50: compression mechanism (compressor)
60: expansion mechanism (expander)
66: expansion chamber
90: controller means

BEST EMBODIMENT MODE FOR CARRYING OUT THE INVENTION

Hereinafter, an embodiment of the present invention is described in detail with reference to the drawings. An air conditioner (10) of the present embodiment is formed by a refrigeration apparatus of the present invention.

Overall Configuration of the Air Conditioner

As shown in FIG. 1, the air conditioner (10) is a so-called "separate type" air conditioner, and includes an outdoor unit (11) and an indoor unit (13). The outdoor unit (11) houses therein an outdoor heat exchanger (23), a four way switch valve (21), a bridge circuit (22), an accumulator (25), and a compression/expansion unit (30). The indoor unit (13) houses therein an indoor heat exchanger (24). The outdoor unit (11) is installed outside a building. The indoor unit (13) is installed inside the building. In addition, the outdoor unit (11) and the indoor unit (13) are connected together by a pair of interconnecting pipelines (15, 16). Details about the compression/expansion unit (30) will be described later.

The air conditioner (10) has a refrigerant circuit (20). The refrigerant circuit (20) is a closed circuit along which the compression/expansion unit (30), the indoor heat exchanger (24), and other circuit components are provided. The refrigerant circuit (20) is charged with carbon dioxide ($CO_2$) as a refrigerant.

Both the outdoor heat exchanger (23) and the indoor heat exchanger (24) are implemented by fin and tube heat exchangers of the cross fin type. In the outdoor heat exchanger (23), the refrigerant circulating in the refrigerant circuit (20) exchanges heat with outdoor air. In the indoor heat exchanger (24), the refrigerant circulating in the refrigerant circuit (20) exchanges heat with indoor air.

Figure 2:
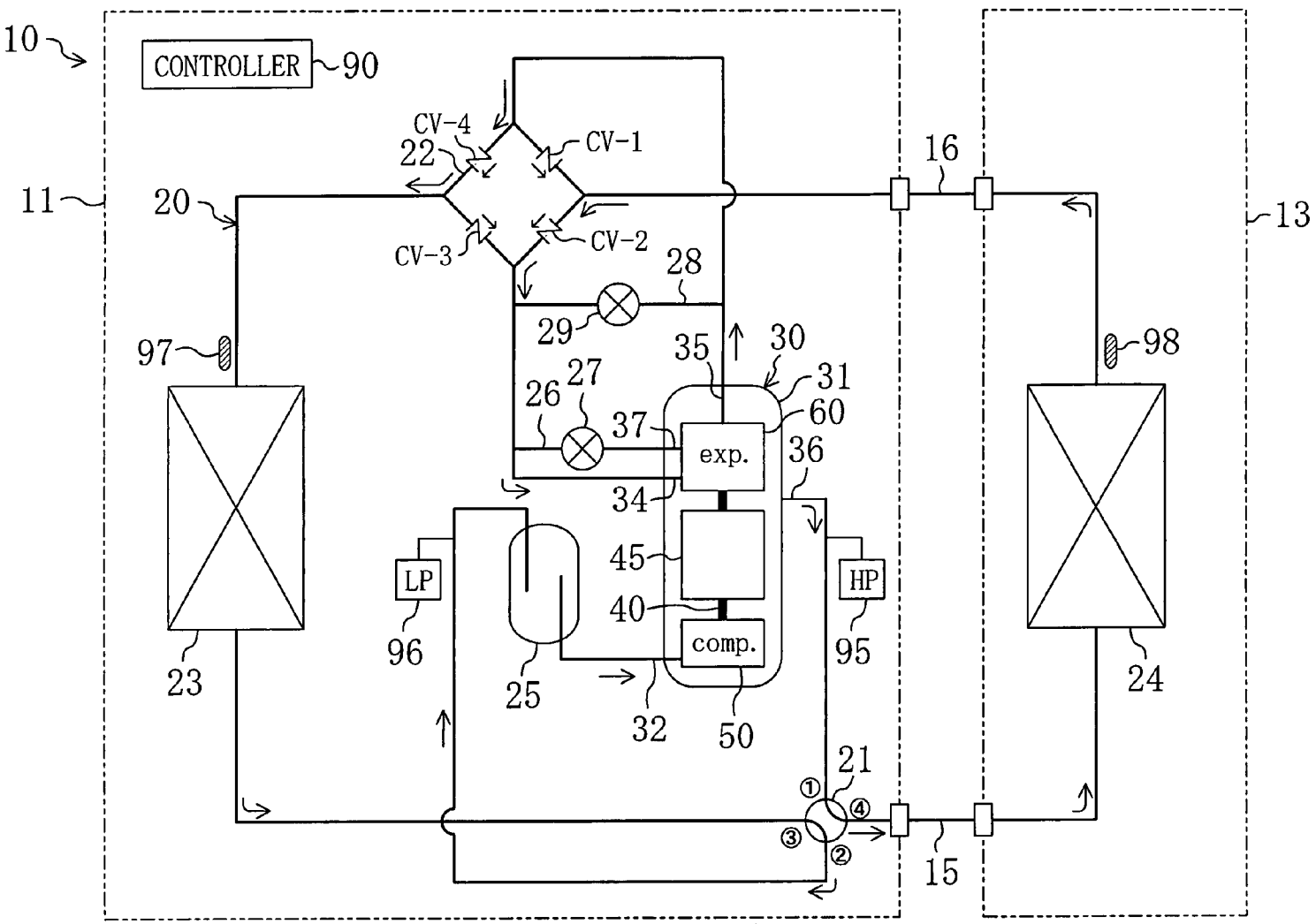
FIG. 2 is a schematic block diagram which shows the configuration of an air conditioner and an operation in the heating mode.

The four way switch valve (21) has four ports. In the four way switch valve (21), the first port is fluidly connected to a discharge pipe (36) of the compression/expansion unit (30); the second port is fluidly connected to a suction port (32) of the compression/expansion unit (30) via the accumulator (25); the third port is fluidly connected to one end of the outdoor heat exchanger (23); and the fourth port is fluidly connected to one end of the indoor heat exchanger (24) via the interconnecting pipeline (15). And, the four way switch valve (21) is switchable between a first state that allows fluid communication between the first port and the third port and fluid communication between the second port and the fourth port (as indicated in FIG. 1) and a second state that allows fluid communication between the first port and the fourth port and fluid communication between the second port and the third port (as indicated in FIG. 2).

The bridge circuit (22) comprises a bridge connection of four check valves (CV-1, CV-2, CV-3, CV-4). In the bridge circuit (22), the inflow side of the first check valve (CV-1) and the inflow side of the fourth check valve (CV-4) are fluidly connected to an outflow port (35) of the compression/expansion unit (30); the outflow side of the second check valve (CV-2) and the outflow side of the third check valve (CV-3) are fluidly connected to an inflow port (34) of the compression/expansion unit (30); the outflow side of the first check valve (CV-1) and the inflow side of the second check valve (CV-2) are fluidly connected, through the interconnecting pipeline (16), to the other end of the indoor heat exchanger (24); and the inflow side of the third check valve (CV-3) and the outflow side of the fourth check valve (CV-4) are fluidly connected to the other end of the outdoor heat exchanger (23).

The refrigerant circuit (20) is provided with an injection pipeline (26). The injection pipeline (26) constitutes an injection passageway. More specifically, one end of the injection pipeline (26) is fluidly connected between the bridge circuit (22) and the inflow port (34) of the compression/expansion unit (30) while the other end of the injection pipeline (26) is fluidly connected to an injection port (37) of the compression/expansion unit (30). The injection pipeline (26) has an injection valve (27). The injection valve (27) is a motor operated valve for regulating the refrigerant flow rate in the injection pipeline (26), and constitutes a flow rate control valve.

The refrigerant circuit (20) further includes a bypass pipeline (28). The bypass pipeline (28) constitutes a bypass passageway. More specifically, one end of the bypass pipeline (28) is fluidly connected between the bridge circuit (22) and the inflow port (34) of the compression/expansion unit (30) while the other end of the bypass pipeline (28) is fluidly connected between the inflow port (34) of the compression/expansion unit (30) and the bridge circuit (22). The bypass pipeline (28) has a bypass valve (29). The bypass valve (29) is a motor operated valve for regulating the refrigerant flow rate in the bypass pipeline (28), and constitutes a bypass control valve.

The refrigerant circuit (20) of the air conditioner (10) is provided with temperature sensors and pressure sensors. More specifically, a high pressure sensor (95) is disposed which is connected to a pipeline which establishes connection between the discharge pipe (36) of the compression/expansion unit (30) and the four way switch valve (21). The high pressure sensor (95) detects the pressure of high pressure refrigerant discharged out of the compression/expansion unit (30). A low pressure sensor (96) is disposed which is connected to a pipeline which establishes connection between the four way switch valve (21) and the suction port (32) of the compression/expansion unit (30). The low pressure sensor (96) detects the pressure of low pressure refrigerant which is drawn into the compression/expansion unit (30). An outdoor side refrigerant temperature sensor (97) is arranged in the vicinity of the end of the outdoor heat exchanger (23) located on the side of the bridge circuit (22). An indoor side refrigerant temperature sensor (98) is arranged in the vicinity of the end of the indoor heat exchanger (24) located on the side of the interconnecting pipeline (16).

The air conditioner (10) is provided with a controller (90) which constitutes a controller means. Values detected in the high pressure sensor (95), the low pressure sensor (96), the outdoor side refrigerant temperature sensor (97), and the indoor side refrigerant temperature sensor (98) are fed to the controller (90). Based on the detected values obtained in these sensors, the controller (90) sets a control target value of the high pressure of the refrigeration cycle and controls the position of the injection valve (27) and the position of the bypass valve (29) so that the detected value of the high pressure sensor (95) becomes the control target value.

Configuration of the Compression/Expansion Unit

Figure 3:
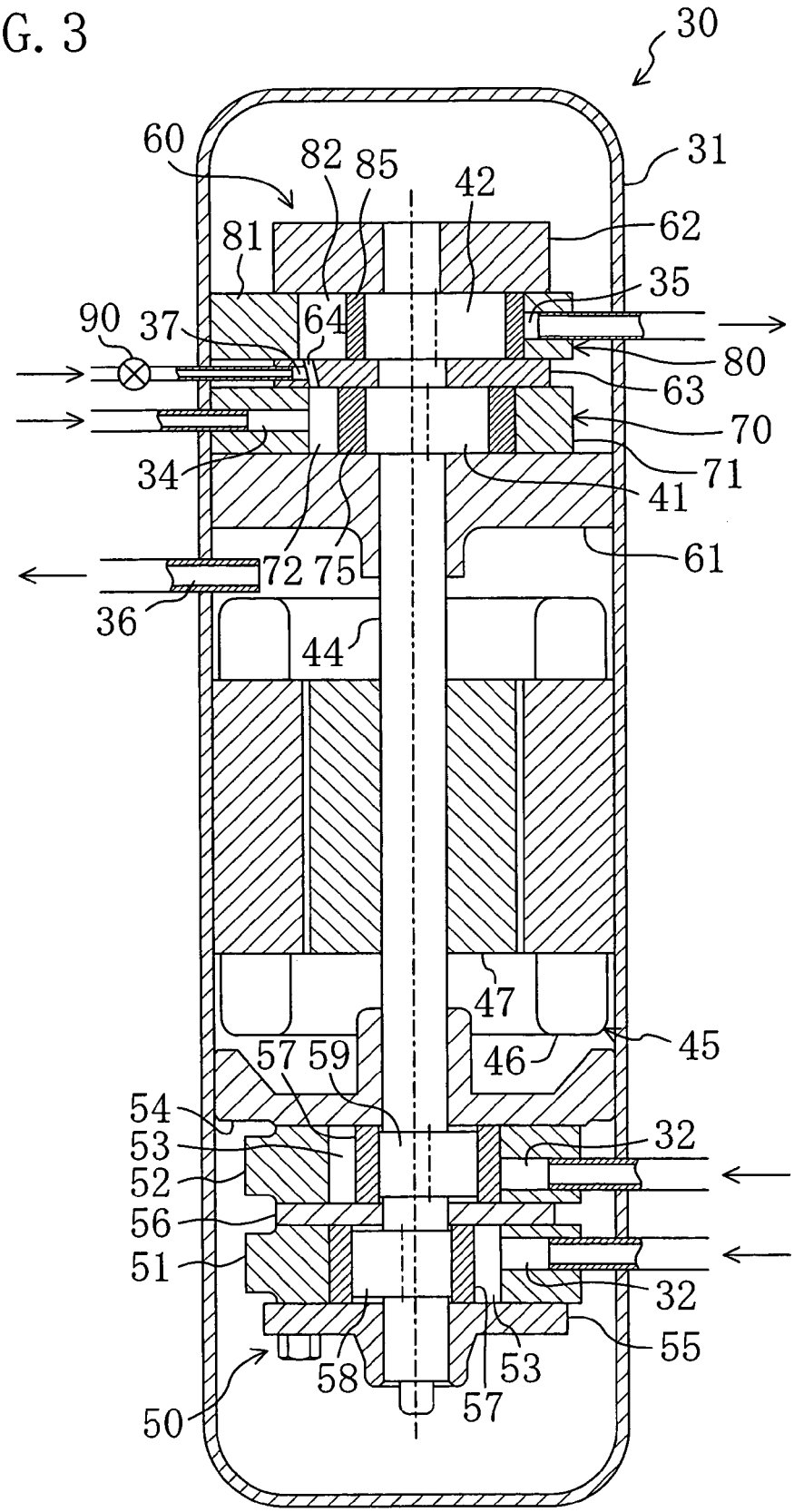
FIG. 3 is a schematic cross sectional view of a compression/expansion unit.

As shown in FIG. 3, the compression/expansion unit (30) includes a casing (31) which is a vertically long, cylinder-shaped, hermitically-closed container. Arranged, in sequence in a vertical direction from the bottom to the top, within the casing (31) are a compression mechanism (50), an electric motor (45), and an expansion mechanism (60).

The discharge pipe (36) is connected to the casing (31). The discharge pipe (36), arranged between the electric motor (45) and the expansion mechanism (60), is brought into fluid communication with the internal space of the casing (31).

The electric motor (45) lies longitudinally centrally in the casing (31). The electric motor (45) is made up of a stator (46) and a rotor (47). The stator (46) is firmly secured to the casing (31). The rotor (47) is disposed inside the stator (46). In addition, a main shaft part (44) of a shaft (40) is passed, coaxially with the rotor (47), through the rotor (47).

The shaft (40) has, at its lower end side, two lower side eccentric parts (58, 59). These two lower side eccentric parts (58, 59) are formed such that their diameter is greater than that of the main shaft part (44). Of the two lower side eccentric parts (58, 59), the underlying one constitutes a first lower side eccentric part (58) and the overlying one constitutes the second lower side eccentric part (59). The first lower side eccentric part (58) and the second lower side eccentric part (59) are opposite to each other in eccentric direction relative to the center of axle of the main shaft part (44).

The shaft (40) further has, at its upper end side, two greater diameter eccentric parts (41, 42). These two greater diameter eccentric parts (41, 42) are formed such that their diameter is greater than that of the main shaft part (44). Of the two greater diameter eccentric parts (41, 42), the underlying one constitutes a first greater diameter eccentric part (41) and the overlying one constitutes a second greater diameter eccentric part (42). The first and second greater diameter eccentric parts (41, 42) are made eccentric in the same direction. The outer diameter of the second greater diameter eccentric part (42) is made greater than the outer diameter of the first greater diameter eccentric part (41). In addition, the second greater diameter eccentric part (42) is greater, in the amount of eccentricity relative to the center of axle of the main shaft part (44), than the first greater diameter eccentric part (41).

The compression mechanism (50) constitutes a swinging piston type rotary compressor. The compressor mechanism (50) has two cylinders (51, 52) and two pistons (57, 57). A rear head (55), a first cylinder (51), an intermediate plate (56), a second cylinder (52), and a front head (54) are arranged sequentially in layers in a vertical direction from the bottom to the top of the compression mechanism (50).

The first and second cylinders (51, 52) each contain therein a respective cylindrical piston (57). Although not shown diagrammatically, a flat plate-like blade is projectingly provided on the side surface of the piston (57). This blade is supported, through a swinging bush, on the cylinder (51, 52). The piston (57) within the first cylinder (51) engages with the first lower side eccentric part (58) of the shaft (40). On the other hand, the piston (57) within the second cylinder (52) engages with the second lower side eccentric part (59) of the shaft (40). The piston (57, 57) is, at its inner peripheral surface, in sliding contact with the outer peripheral surface of the lower side eccentric part (58, 59). In addition, the piston (57, 57) is, at its outer peripheral surface, in sliding contact with the inner peripheral surface of the cylinder (51, 52). And, a compression chamber (53) is formed between the outer peripheral surface of the piston (57, 57) and the inner peripheral surface of the cylinder (51, 52).

The first and second cylinders (51, 52) each have a respective suction port (33). The suction port (33) radially extends through the cylinder (51, 52) and its terminal end opens at the inner peripheral surface of the cylinder (51, 52). In addition, each suction port (33) is extended to outside the casing (31) by a pipeline.

Each of the front head (54) and the rear head (55) has a respective discharge port. The discharge port of the front head (54) allows the compression chamber (53) within the second cylinder (52) to fluidly communicate with the internal space of the casing (31). The discharge port of the rear head (55) allows the compression chamber (53) within the first cylinder (51) to fluidly communicate with the internal space of the casing (31). In addition, each of the discharge ports is provided, at its terminal end, with a respective discharge valve formed by a reed valve. Each discharge port is placed in the opened or closed state by its associated discharge valve. Note that neither the discharge ports nor the discharge valves are diagrammatically shown in FIG. 3. And, gas refrigerant discharged into the internal space of the casing (31) from the compression mechanism (50) is fed out of the compression/expansion unit (30) by way of the discharge pipe (36).

The expansion mechanism (60) constitutes a so-called swinging piston type rotary expander. The expansion mechanism (60) is provided with two pair combinations of cylinders (71, 81) and pistons (75, 85). In addition, the expansion mechanism (60) further includes a front head (61), an intermediate plate (63), and a rear head (62).

The front head (61), the first cylinder (71), the intermediate plate (63), the second cylinder (81), and the rear head (62) are arranged sequentially in layers in a vertical direction from the bottom to the top of the expansion mechanism (60). In this arrangement, the lower end surface of the first cylinder (71) is blocked by the front head (61) and the upper end surface of the first cylinder (71) is blocked by the intermediate plate (63). On the other hand, the lower end surface of the second cylinder (81) is blocked by the intermediate plate (63) and the upper end surface of the second cylinder (81) is blocked by the rear head (62). In addition, the inside diameter of the second cylinder (81) is greater than the inside diameter of the first cylinder (71).

The shaft (40) is passed through the front head (61), the first cylinder (71), the intermediate plate (63), the second cylinder (81), and the rear head (62) which are arranged in layers. Additionally, the first greater diameter eccentric part (41) of the shaft (40) lies within the first cylinder (71) while on the other hand the second greater diameter eccentric part (42) of the shaft (40) lies within the second cylinder (81).

Figure 4:
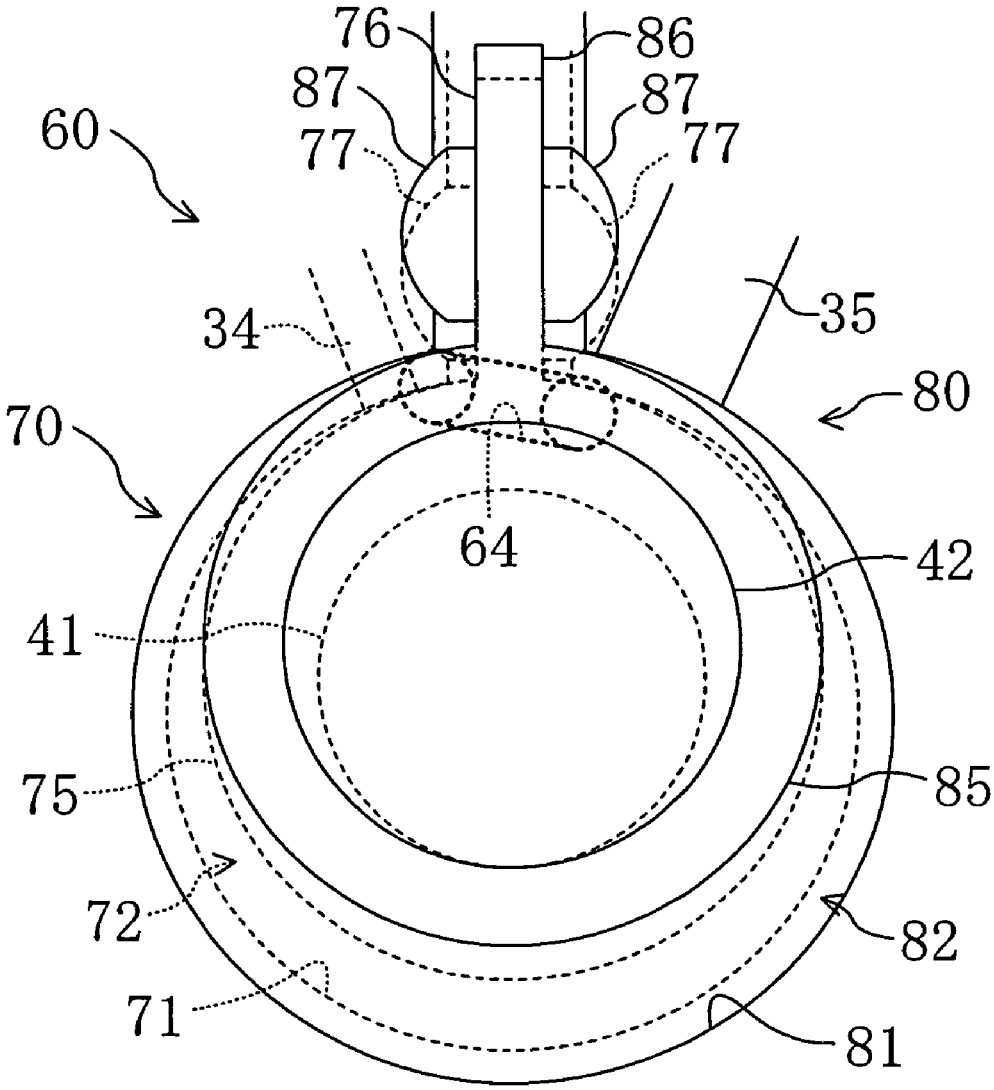
FIG. 4 is a diagram which illustrates in enlarged manner a major part of an expansion mechanism.
Figure 5:
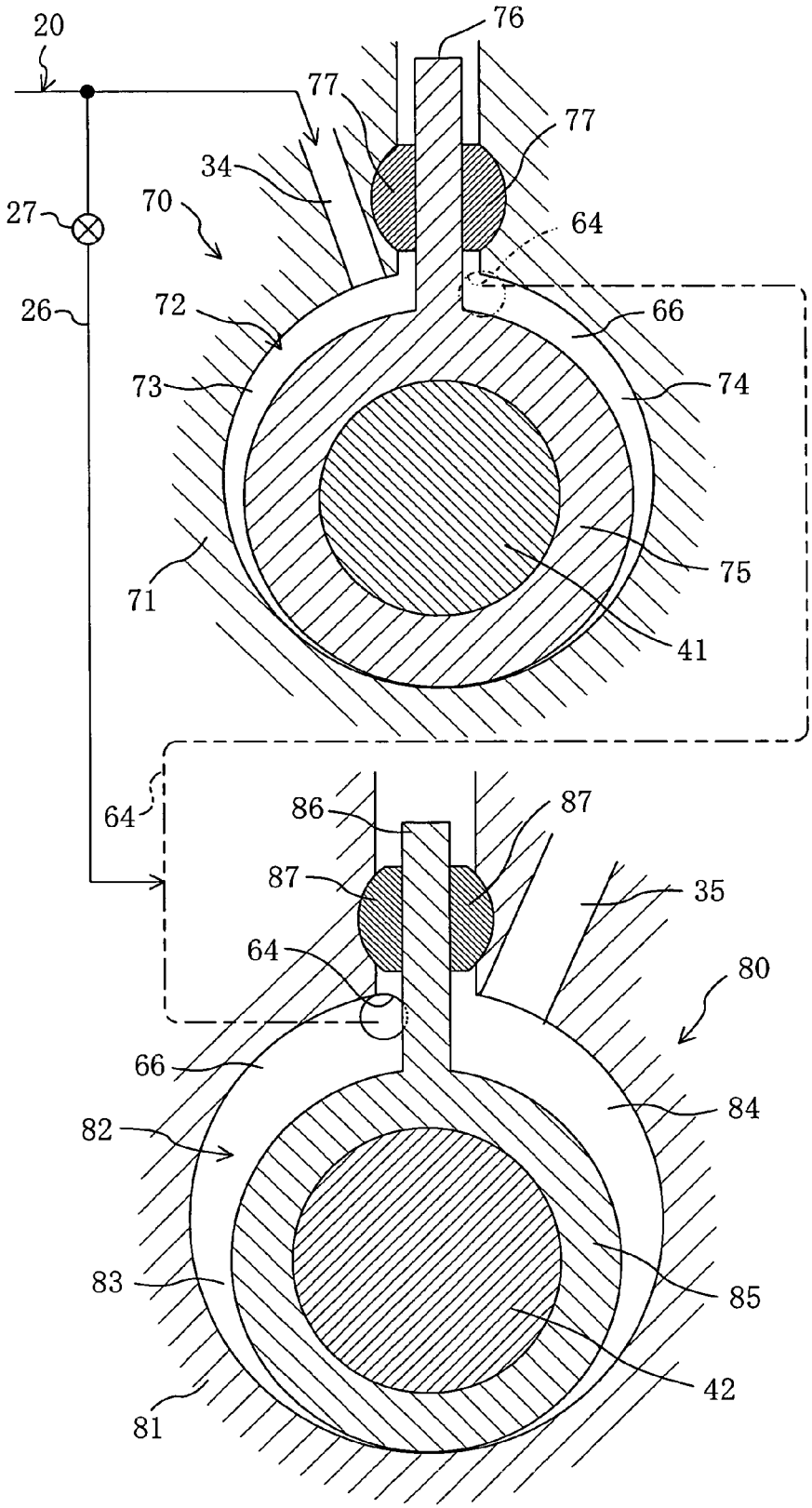
FIG. 5 is a cross sectional view which individually diagrams each rotary mechanism of the expansion mechanism.
Figure 6:
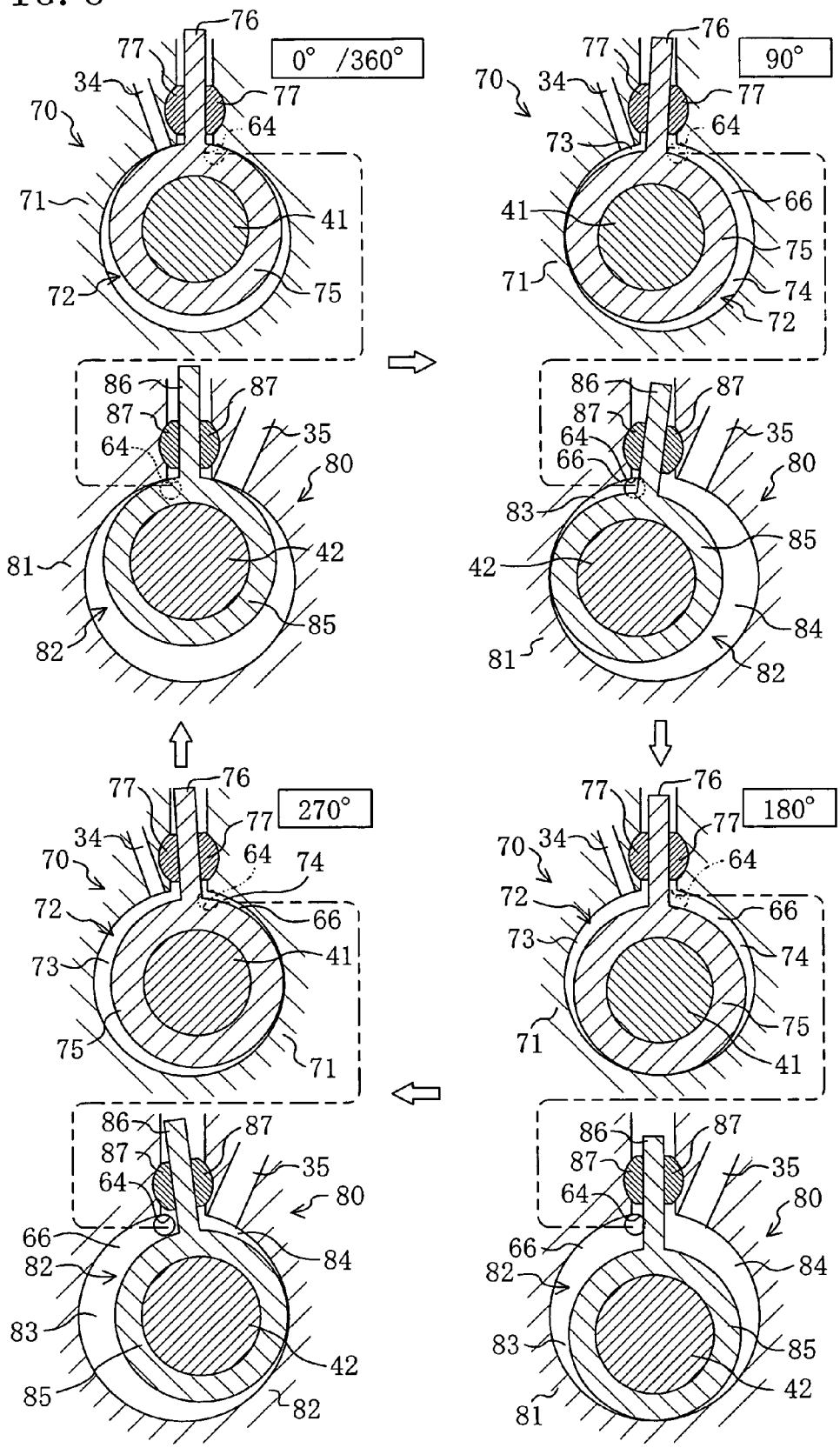
FIG. 6 is a diagram which illustrates in cross section the states of each rotary mechanism for each 90° rotation angle of the shaft of the expansion mechanism.

As shown in FIGS. 4-6, the first piston (75) is placed within the first cylinder (71) and the second piston (85) is placed within the second cylinder (81). The first and second pistons (75, 85) are each shaped like a circular ring or like a cylinder. The first piston (75) and the second piston (85) have the same outside diameter. The inside diameter of the first piston (75) approximately equals the outside diameter of the first greater diameter eccentric part (41). The inside diameter of the second piston (85) approximately equals the outside diameter of the second greater diameter eccentric part (42). And, the first greater diameter eccentric part (41) is passed through the first piston (75) and the second greater diameter eccentric part (42) is passed through the second piston (85).

The first piston (75) is, at its outer peripheral surface, in sliding contact with the inner peripheral surface of the first cylinder (71). One end surface of the first piston (75) is in sliding contact with the front head (61). The other end surface of the first piston (75) is in sliding contact with the intermediate plate (63). Within the first cylinder (71), a first expansion chamber (72) is formed between the inner peripheral surface of the first cylinder (71) and the outer peripheral surface of the first piston (75). On the other hand, the second piston (85) is, at its outer peripheral surface, in sliding contact with the inner peripheral surface of the second cylinder (81). One end surface of the second piston (85) is in sliding contact with the rear head (62). The other end surface of the second piston (85) is in sliding contact with the intermediate plate (63). Within the second cylinder (81), a second expansion chamber (82) is formed between the inner peripheral surface of the second cylinder (81) and the outer peripheral surface of the second piston (85).

The first piston (75) is provided with an integrally formed blade (76). The second piston (85) is provided with an integrally formed blade (86). The blade (76, 86) is shaped like a plate extending in the radial direction of the piston (75, 85), and projects outwardly from the outer peripheral surface of the piston (75, 85).

Each cylinder (71, 81) is provided with a respective pair of bushes (77, 87). Each bush (77, 87) is a small piece which is formed such that its inside surface is a flat surface and its outside surface is a circular arc surface. One pair of bushes (77, 87) are disposed with the blade (76, 86) sandwiched therebetween. The inside surface of the bush (77, 87) slides against the blade (76, 86) while on the other hand the outside surface of the bush (77, 87) slides against the cylinder (71, 81). And, the blade (76, 86) integral with the piston (75, 85) is supported on the cylinder (71, 81) through the bushes (77, 87). The blade (76, 86) is capable of rotating against the cylinder (71, 81) and capable of moving towards or away from the cylinder (71, 81).

The first expansion chamber (72) within the first cylinder (71) is divided by the first blade (76) integral with the first piston (75) into two spaces. One space defined on the left-hand side of the first blade (76) in FIG. 5 becomes a first high pressure chamber (73) on the high pressure side and the other space defined on the right-hand side of the first blade (76) in FIG. 5 becomes a first low pressure chamber (74) on the low pressure side. The second expansion chamber (82) within the second cylinder (81) is divided by the second blade (86) integral with the second piston (85) into two spaces. One space defined on the left-hand side of the second blade (86) in FIG. 5 becomes a second high pressure chamber (83) on the high pressure side and the other space defined on the right-hand side of the second blade (86) in FIG. 5 becomes a second low pressure chamber (84) on the low pressure side.

The first cylinder (71) and the second cylinder (81) are arranged in such orientation that the circumferential position of the bushes (77) of the first cylinder (71) and the circumferential position of the bushes (87) of the second cylinder (81) agree with each other. In other words, the angle at which the second cylinder (81) is arranged against the first cylinder (71) is 0 degrees. As described above, the first greater diameter eccentric part (41) and the second greater diameter eccentric part (42) are made eccentric relative to the center of axle of the main shaft part (44) in the same direction. Accordingly, at the same time that the first blade (76) reaches its most withdrawn position relative to the direction of the outer periphery of the first cylinder (71), the second blade (86) also reaches its most withdrawn position relative to the direction of the outer periphery of the second cylinder (81).

The first cylinder (71) is provided with an inflow port (34). The inflow port (34) opens at a location of the inner peripheral surface of the first cylinder (71) situated somewhat to the left side of the bush (77) in FIGS. 4 and 5. The inflow port (34) is allowed to be in fluid communication with the first high pressure chamber (73) (i.e., the high pressure side of the first expansion chamber (72)). On the other hand, the second cylinder (81) is provided with an outflow port (35). The outflow port (35) opens at a location of the inner peripheral surface of the second cylinder (81) situated somewhat to the right side of the bush (87) in FIGS. 4 and 5. The outflow port (35) is allowed to be in fluid communication with the second low pressure chamber (84) (i.e., the low pressure side of the second expansion chamber (82)).

The intermediate plate (63) is provided with a communicating passageway (64). The communicating passageway (64) is formed such that it extends through the intermediate plate (63) in the thickness direction thereof. In one surface of the intermediate plate (63) on the side of the first cylinder (71), one end of the communicating passageway (64) opens at a location on the right side of the first blade (76). In the other surface of the intermediate plate (63) on the side of the second cylinder (81), the other end of the communicating passageway (64) opens at a location on the left side of the second blade (86). And, as shown in FIG. 4, the communicating passageway (64) extends obliquely relative to the thickness direction of the intermediate plate (63), thereby allowing the first low pressure chamber (74) (i.e., the low pressure side of the first expansion chamber (72)) and the second high pressure chamber (83) (i.e., the high pressure side of the second expansion chamber (82)) to fluidly communicate with each other.

The intermediate plate (63) is provided with an injection port (37) (see FIG. 3). The injection port (37) is formed such that it extends substantially in a horizontal direction and its terminal end opens to the communicating passageway (64). The start end of the injection port (37) extends to outside the casing (31) via a pipeline. As described above, the injection pipeline (26) is connected to the injection port (37).

In the expansion mechanism (60) of the present embodiment constructed in the way as described above, the first cylinder (71), the bushes (77) mounted in the first cylinder (71), the first piston (75), and the first blade (76) together constitute a first rotary mechanism (70). In addition, the second cylinder (81), the bushes (87) mounted in the second cylinder (81), the second piston (85), and the second blade (86) together constitute a second rotary mechanism (80).

As described above, in the expansion mechanism (60), the timing at which the first blade (76) reaches its most withdrawn position relative to the direction of the outer periphery of the first cylinder (71) and the timing at which the second blade (86) reaches its most withdrawn position relative to the direction of the outer periphery of the second cylinder (81) are synchronized with each other. In other words, the process in which the volume of the first low pressure chamber (74) decreases in the first rotary mechanism (70) and the process in which the volume of the second high pressure chamber (83) increases in the second rotary mechanism (80) are in synchronization (see FIG. 6). In addition, as described above, the first low pressure chamber (74) of the first rotary mechanism (70) and the second high pressure chamber (83) of the second rotary mechanism (80) are in fluid communication with each other via the communicating passage (64). And, the first low pressure chamber (74), the communicating passage (64), and the second high pressure chamber (83) together form a single closed space. This closed space constitutes the expansion chamber (66). This is described with reference to FIG. 7.

Figure 7:
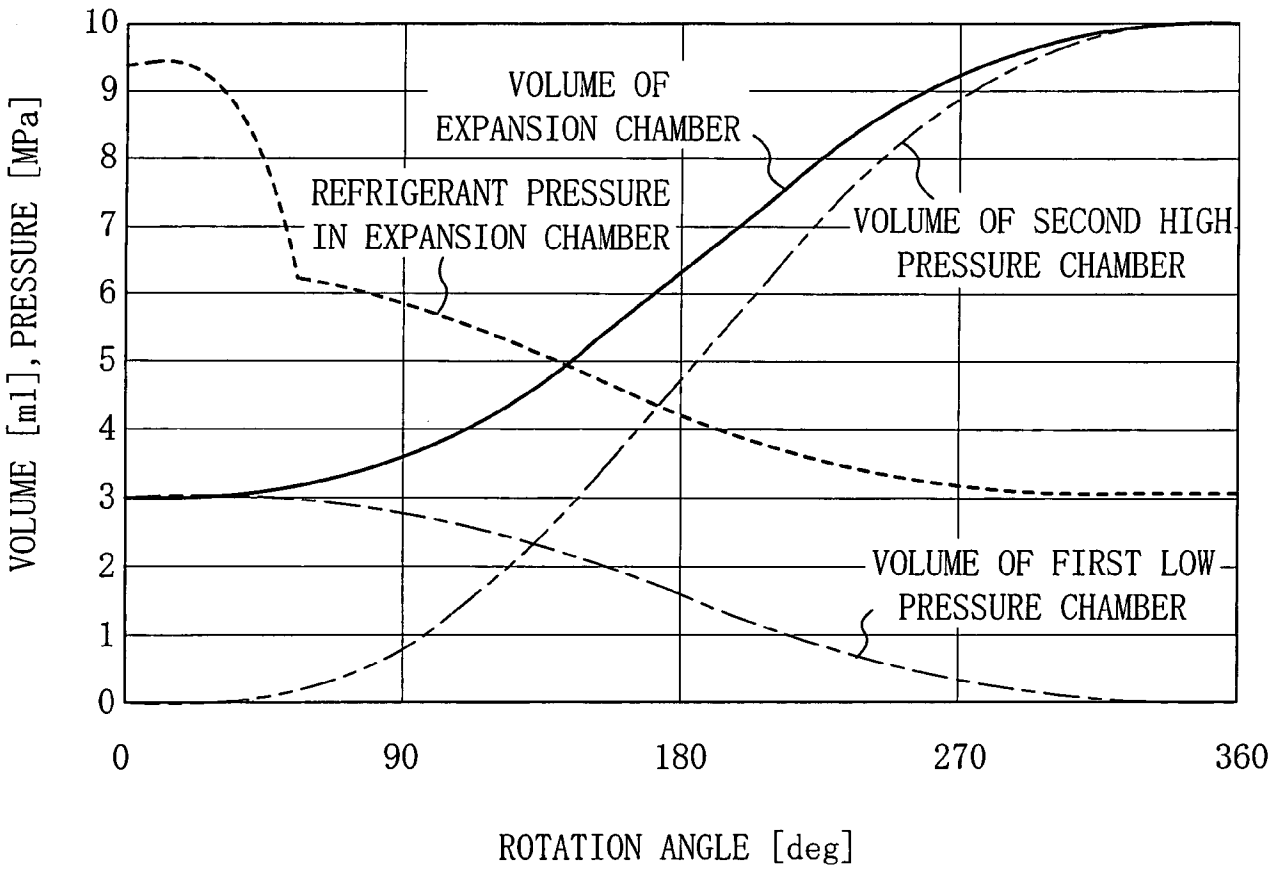
FIG. 7 is a relationship diagram which represents relationships of the rotation angle of the shaft with respect to the volumes of chambers including an expansion chamber and with respect to the internal pressure of the expansion chamber in the expansion mechanism.

In FIG. 7, the rotation angle of the shaft (40) when the first blade (76) reaches its most withdrawn position relative to the direction of the outer periphery of the first cylinder (71) is 0 degrees. In addition, the description will be made on the condition that the maximum volume of the first expansion chamber (72) is, for example, 3 ml (milliliter) and the maximum volume of the second expansion chamber (82) is, for example, 10 ml.

With reference to FIG. 7, at the point of time when the rotation angle of the shaft (40) is 0 degrees, the volume of the first low pressure chamber (74) reaches its maximum value of 3 ml and the volume of the second high pressure chamber (83) reaches its minimum value of 0 ml. The volume of the first low pressure chamber (74), as indicated by the alternate long and short dash line in FIG. 7, gradually diminishes as the shaft (40) rotates and, at the point of time when the rotation angle of the shaft (40) reaches 360 degrees, reaches its minimum value of 0 ml. On the other hand, the volume of the second high pressure chamber (83), as indicated by the chain double-dashed line in FIG. 7, gradually increases as the shaft (40) rotates and, at the point of time when the rotation angle of the shaft (40) reaches 360 degrees, reaches its maximum value of 10 ml. And, the volume of the expansion chamber (66) at a certain rotation angle is a sum of the volume of the first low pressure chamber (74) and the volume of the second high pressure chamber (83) at that certain rotation angle, when leaving the volume of the communicating passage (64) out of count. In other words, the volume of the expansion chamber (66), as indicated by the solid line in FIG. 7, reaches a minimum value of 3 ml at the point of time when the rotation angle of the shaft (40) is 0 degrees. As the shaft (40) rotates, the volume of the expansion chamber (66) gradually increases and reaches a maximum value of 10 ml at the point of time when the rotation angle of the shaft (40) reaches 360 degrees.

Running Operation

The operation of the air conditioner (10) is described. Hereinafter, the operation of the air conditioner (10) during the cooling mode and the operation of the air conditioner (10) during the heating mode are described, and the operation of the expansion mechanism (60) is described.

Cooling Mode

In the cooling mode, the four way switch valve (21) is set to the state shown in FIG. 1. In this state, upon energization of the electric motor (45) of the compression/expansion unit (30), the refrigerant circulates in the refrigerant circuit (20) and a vapor compression refrigeration cycle is carried out, during which cycle the outdoor heat exchanger (23) operates as a heat dissipator and the indoor heat exchanger (24) operates as an evaporator. Note here that the description will be made on the condition that the injection valve (27) and the bypass valve (29) are fully closed.

The refrigerant compressed in the compression mechanism (50) is discharged out of the compression/expansion unit (30) and passes through the discharge pipe (36). In this state, the refrigerant is at a pressure above its critical pressure. This discharged refrigerant is delivered, through the four way switch valve (21), to the outdoor heat exchanger (23). In the outdoor heat exchanger (23), the inflow refrigerant dissipates heat to outdoor air.

The refrigerant after heat dissipation in the outdoor heat exchanger (23) passes through the third check valve (CV-3) of the bridge circuit (22) and then flows, through the inflow port (34), into the expansion mechanism (60) of the compression/expansion unit (30). In the expansion mechanism (60), the high pressure refrigerant is caused to expand and its internal energy is converted into power which is used to rotate the shaft (40). The low pressure refrigerant after expansion flows out of the compression/expansion unit (30) by way of the outflow port (35), passes through the first check valve (CV-1) of the bridge circuit (22), and is delivered to the indoor heat exchanger (24).

In the indoor heat exchanger (24), the inflow refrigerant absorbs heat from indoor air and is caused to evaporate and, as a result, the indoor air is cooled. The low pressure gas refrigerant exiting the indoor heat exchanger (24) passes through the four way switch valve (21) and is then drawn, through the suction port (32), into the compression mechanism (50) of the compression/expansion unit (30). The compression mechanism (50) compresses the drawn refrigerant and then discharges it.

Heating Mode

In the heating mode, the four way switch valve (21) changes state to the state indicated by the solid line in FIG. 2. In this state, upon energization of the electric motor (45) of the compression/expansion unit (30), the refrigerant circulates in the refrigerant circuit (20) and a vapor compression refrigeration cycle is carried out, during which cycle the indoor heat exchanger (24) operates as a heat dissipator and the outdoor heat exchanger (23) operates as an evaporator. Note here that the description will be made on the condition that the injection valve (27) and the bypass valve (29) are fully closed.

The refrigerant compressed in the compression mechanism (50) is discharged out of the compression/expansion unit (30) and passes through the discharge pipe (36). In this state, the refrigerant is at a pressure above its critical pressure. This discharged refrigerant is delivered, through the four way switch valve (21), to the indoor heat exchanger (24). In the indoor heat exchanger (24), the inflow refrigerant dissipates heat to indoor air and, as a result, the indoor air is heated.

The refrigerant after heat dissipation in the indoor heat exchanger (24) passes through the second check valve (CV-2) of the bridge circuit (22) and then flows, through the inflow port (34), into the expansion mechanism (60) of the compression/expansion unit (30). In the expansion mechanism (60), the high pressure refrigerant is caused to expand and its internal energy is converted into power which is used to rotate the shaft (40). The low pressure refrigerant after expansion flows out of the compression/expansion unit (30) by way of the outflow port (35), passes through the fourth check valve (CV-4) of the bridge circuit (22), and is delivered to the outdoor heat exchanger (23).

In the outdoor heat exchanger (23), the inflow refrigerant absorbs heat from outdoor air and is caused to evaporate. The low pressure gas refrigerant leaving the outdoor heat exchanger (23) passes through the four way switch valve (21) and is then drawn, through the suction port (32), into the compression mechanism (50) of the compression/expansion unit (30). The compression mechanism (50) compresses the drawn refrigerant and then discharges it.

Operation of the Expansion Mechanism

The operation of the expansion mechanism (60) is described below.

In the first place, by making reference to FIG. 6, a first process is described in which high pressure refrigerant in the supercritical state flows into the first high pressure chamber (73) of the first rotary mechanism (70). When the shaft (40) makes a slight rotation from the rotation angle 0° state, the position of contact between the first piston (75) and the first cylinder (71) passes through the opening part of the inflow port (34), and the high pressure refrigerant starts flowing into the first high pressure chamber (73) from the inflow port (34). Thereafter, as the rotation angle of the shaft (40) gradually increases to 90 degrees, then to 180 degrees, and then to 270 degrees, the high pressure refrigerant keeps flowing into the first high pressure chamber (73). The inflowing of the high pressure refrigerant into the first high pressure chamber (73) continues until the rotation angle of the shaft (40) reaches 360 degrees.

Next, by making reference still to FIG. 6, a second process is described in which refrigerant is caused to expand in the expansion mechanism (60). When the shaft (40) makes a slight rotation from the rotation angle 0° state, the first low pressure chamber (74) and the second high pressure chamber (83) become fluidly communicative with each other via the communicating passageway (64), and the refrigerant starts flowing into the second high pressure chamber (83) from the first low pressure chamber (74). Thereafter, as the rotation angle of the shaft (40) gradually increases to 90 degrees, then to 180 degrees, and then to 270 degrees, the volume of the first low pressure chamber (74) gradually decreases while simultaneously the volume of the second high pressure chamber (83) gradually increases. Consequently, the volume of the expansion chamber (66) gradually increases. This increase in the volume of the expansion chamber (66) continues just before the rotation angle of the shaft (40) reaches 360 degrees. And, in the process during which the volume of the expansion chamber (66) increases, the refrigerant in the expansion chamber (66) expands. Because of such refrigerant expansion, the shaft (40) is rotationally driven. In this way, the refrigerant within the first low pressure chamber (74) flows, through the communication passage (64), into the second high pressure chamber (83) while it is expanding.

In the refrigerant expansion process, the refrigerant pressure within the expansion chamber (66) gradually falls as the rotation angle of the shaft (40) increases, as indicated by the broken line in FIG. 7. More specifically, the supercritical-state refrigerant with which the first low pressure chamber (74) is filled up undergoes an abrupt pressure drop during the time until the rotation angle of the shaft (40) reaches about 55 degrees, and enters the saturated liquid state. Thereafter, the refrigerant within the expansion chamber (66) gradually decreases in pressure while it is partially evaporating.

Next, by making reference still to FIG. 6, a third process is described in which refrigerant flows out of the second low pressure chamber (84) of the second rotary mechanism (80). The second low pressure chamber (84) starts fluidly communicating with the outflow port (35) from the point of time when the rotation angle of the shaft (40) is 0 degrees. Stated another way, the refrigerant starts flowing out to the outflow port (35) from the second low pressure chamber (84). Thereafter, the rotation angle of the shaft (40) gradually increases to 90 degrees, then to 180 degrees, and then to 270 degrees. Over a period of time until the rotation angle of the shaft (40) reaches 360 degrees, the low pressure refrigerant after expansion continuously flows out of the second low pressure chamber (84).

Control Operation of the Controller

The controller (90) performs a primary control operation and an auxiliary control operation. The controller (90) in the primary control operation adjusts the position of the injection valve (27), with the bypass valve (29) held in the fully closed state. The controller (90) commences the auxiliary control operation, when the injection valve (27) enters the fully open state during the primary control operation, i.e., when the refrigerant flow rate in the injection pipeline (26) cannot be increased any more. The controller (90) in the auxiliary control operation adjusts the position of the bypass valve (29), with the injection valve (27) having entered the fully opened state, and regulates the refrigerant flow rate in the bypass pipeline (28). The controller (90) resumes the primary control operation, when the bypass valve (29) enters the fully closed state during the auxiliary control state, i.e., when the distribution of the refrigerant in the bypass pipeline (28) is no longer required.

The control operation of the controller (90) is described in detail with reference to a flow chart of FIG. 8. The control operation of the controller (90) shown in FIG. 8 starts, with the bypass valve (29) placed in the fully closed state.

In Step ST10, the controller (90) makes a measure of the operating condition of the air conditioner (10). More specifically, the controller (90) receives output signals from the high pressure sensor (95), the low pressure sensor (96), the outdoor side refrigerant temperature censor (97), and the indoor side refrigerant temperature sensor (98). Subsequently, in Step ST11, the controller (90) uses these detected values from the sensors (95-98) received at Step ST10 to compute a control target value Pd_obj of the high pressure of the refrigeration cycle. This process of computing the control target value Pd_obj will be described later.

Next, in Step ST12, the controller (90) compares a value detected by the high pressure sensor (95), i.e., an actually measured value, Pd, of the high pressure of the refrigeration cycle, with the control target value Pd_obj calculated in Step ST11. If the actually measured value Pd of the high pressure of the refrigeration cycle is found to be equal to or greater than the control target value Pd_obj, the control operation procedure moves to Step ST13. If the actually measured value Pd of the high pressure of the refrigeration cycle falls below the control target value Pd_obj, the control operation procedure moves to Step ST16.

If Pd≧Pd_obj, the controller (90) determines in Step ST13 whether the injection valve (27) is in the fully opened state or not.

If Step ST13 determines that the injection valve (27) has already entered the fully opened state, the control operation procedure moves to Step ST14. In Step ST14, the controller (90) increasingly shifts, while maintaining the injection valve (27) still in the fully opened state, the position of the bypass valve (29) so that either the introducing of the refrigerant into the bypass pipeline (28) starts, or the refrigerant flow rate in the bypass pipeline (28) is increased. In other words, although in this situation the refrigerant flow rate in the injection pipeline (26) cannot be increased any more, the actually measured value, Pd, of the high pressure of the refrigeration cycle is equal to or greater than the control target value Pd_obj. The controller (90) therefore increases the amount of refrigerant that flows into the bypass pipeline (28) in order to reduce the high pressure of the refrigeration cycle.

If the controller (90) determines in Step ST13 that the injection valve (27) has not yet entered the fully opened state, the operation control procedure moves to Step ST15. In Step ST15, the controller (90) increasingly shifts, while maintaining the bypass valve (29) still in the fully closed state, the position of the injection valve (27) so that the refrigerant flow rate in the injection pipeline (26) is increased. In other words, in this situation, unlike the situation of Step ST14, it is possible to increase the refrigerant flow rate in the injection pipeline (26). The controller (90) therefore increases the amount of refrigerant that flows into the injection pipeline (26) in order to reduce the high pressure of the refrigeration cycle.

On the other hand, if Pd<Pd_obj, the controller (90) determines in Step St16 whether the bypass valve (29) is in the fully closed state or not.

If the bypass valve (29) is determined to still remain in the fully closed state in Step ST16, the control operation procedure moves to Step ST17. In Step ST17, the controller (90) decreasingly shifts, while holding the bypass valve (29) still in the fully closed state, the position of the injection valve (27) so that the refrigerant flow rate in the injection pipeline (26) is decreased. In other words, the state in this situation is that the refrigerant has not yet been introduced into the bypass pipeline (28) and the injection valve (27) has not yet entered the fully opened state. The controller (90) therefore decreases the amount of refrigerant that flows into the injection pipeline (26) in order to increase the high pressure of the refrigeration cycle.

If the controller (90) determines in Step ST16 that the bypass valve (29) has not yet entered the fully closed state, the operation control procedure moves to Step ST18. In Step ST18, the controller (90) decreasingly shifts, while holding the injection valve (27) still in the fully opened state, the position of the bypass valve (29) so that either the refrigerant flow rate in the bypass pipeline (28) is decreased, or the introducing of the refrigerant into the bypass pipeline (28) is stopped. In other words, in this situation, the actually measured value, Pd, of the high pressure of the refrigeration cycle becomes lower than the control target value Pd_obj, with the bypass valve (29) already placed in the opened state. The controller (90) therefore reduces the amount of refrigerant that flows into the bypass pipeline (28) in order to increase the high pressure of the refrigeration cycle.

Figure 8:
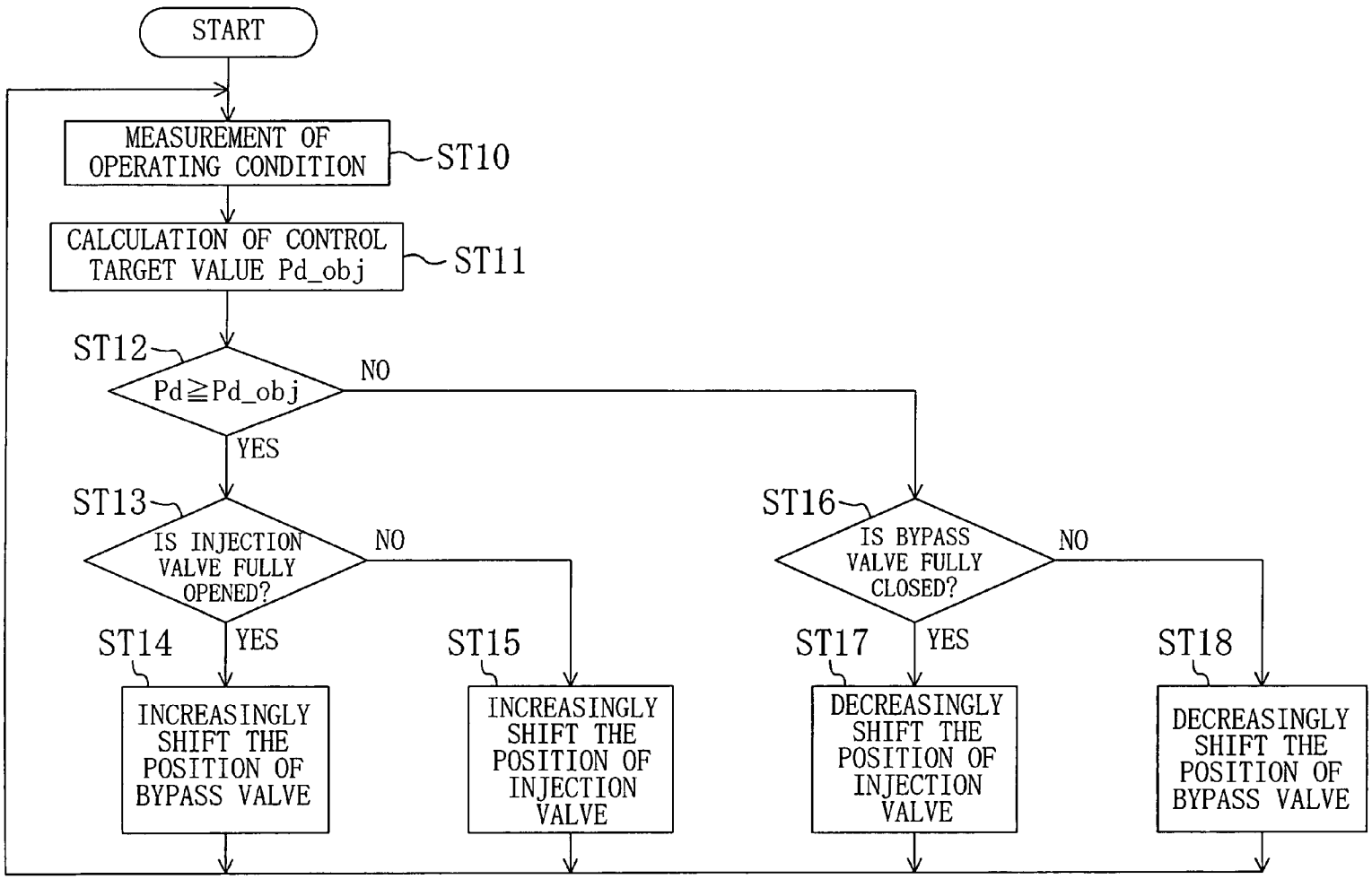
FIG. 8 is a flow chart which illustrates the control operation of a controller.

Referring to FIG. 8, the primary control operation of the controller (90) includes an operation flow of reaching Step ST15 from Steps ST10, ST11, ST12 via Step ST13 and another operation flow of reaching Step ST17 from Steps ST10, ST11, ST12 via Step ST16. In addition, referring still to FIG. 8, the auxiliary control operation of the controller (90) includes an operation flow of reaching Step ST14 from Steps ST10, ST11, ST12 via Step ST13 and another operation flow of reaching Step ST18 from Steps ST10, ST11, ST12 via Step ST16.

The process of computing the control target value Pd_obj of the high pressure of the refrigeration cycle in Step ST11 of FIG. 8 is described.

Figure 9:
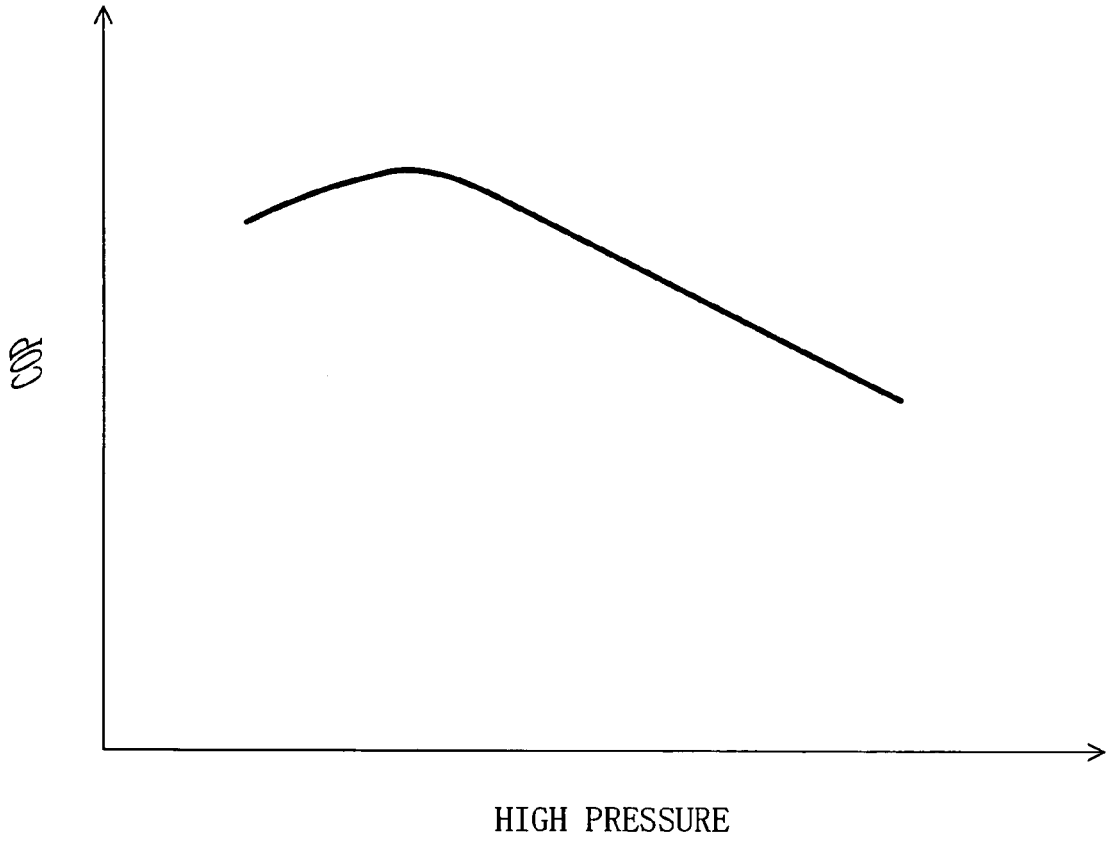
FIG. 9 is a relationship diagram which represents a relationship between the high pressure and the coefficient of performance in a refrigeration cycle in which the high pressure becomes equal to or above the refrigerant critical pressure.

If, in a supercritical cycle in which the high pressure of the refrigeration cycle becomes equal to or greater than the critical pressure of the refrigerant, the refrigerant evaporation temperature (or the refrigerant evaporation pressure) and the refrigerant temperature at the exit of the heat dissipator are fixed, the coefficient of performance (COP) of the refrigeration cycle varies depending on the high pressure of the refrigeration cycle and the COP of the refrigeration cycle becomes maximum when the high pressure of the refrigeration cycle reaches a specific value, as shown in FIG. 9.

Performance testing was performed on the air conditioner (10) in design phases thereof. In the performance testing, the refrigerant evaporation temperature (or the refrigerant evaporation pressure) and the refrigerant temperature at the exit of the heat dissipator were set, in combination, at various values and, for each combination, a value of the high pressure of the refrigeration cycle which provides a maximum COP was decided. The controller (90) stores, in the form of a matrix or correlation equation, correspondences between the combinations of the refrigerant evaporation temperature (pressure) and the refrigerant temperature at the exit of the heat dissipator and the values of the high pressure of the refrigeration cycle which maximize the COP.

During the cooling mode, the controller (90) applies a value detected by the low pressure sensor (96) and a value detected by the outdoor side refrigerant temperature sensor (97) to a stored matrix or correlation equation and sets, as the control target value Pd_obj, a value of the high pressure of the refrigeration cycle which provides a maximum COP available in an existing operating condition. On the other hand, during the heating mode, the controller (90) applies a value detected by the low pressure sensor (96) and a value detected by the indoor side refrigerant temperature sensor (98) to a stored matrix or correlation equation and sets, as the control target value Pd_obj, a value of the high pressure of the refrigeration cycle which provides a maximum COP available in an existing operating condition.

In the way as described above, the controller (90) sets, as the target control value Pd_obj, a value of the high pressure of the refrigeration cycle which provides a maximum COP available in an existing operating condition. And, the controller (90) controls the position of the injection valve (27) and the position of the bypass valve (29) in order that the actually measured value, Pd, of the high pressure of the refrigeration cycle detected by the high pressure sensor (95) may become the control target value Pd_obj.

Effects of the First Embodiment

Even when the air conditioner (10) of the present embodiment enters a state which causes occurrence of an imbalance between the amount of refrigerant that flows through the expansion mechanism (60) and the amount of refrigerant that flows through the compression mechanism (50), the expansion mechanism (60) and the compression mechanism (50) can be balanced with each other in the amount of passing refrigerant by refrigerant introduction into the expansion mechanism (60) also from the injection pipeline (26). Therefore, the refrigerant conventionally made to bypass the expansion mechanism (60) will now be allowed to be introduced into the expansion mechanism (60), and power can be recovered also from the refrigerant from which power cannot conventionally be recovered. Therefore, in accordance with the present embodiment, it becomes possible to realize the air conditioner (10) capable of stable operation in a variety of operating conditions without hardly reducing the amount of power recoverable from the refrigerant.

In addition, in the present embodiment, the controller (90) adjusts the position of the injection valve (27) so as to provide a maximum coefficient of performance. Therefore, in accordance with the present embodiment, the expansion mechanism (60) and the compression mechanism (50) are balanced with each other in the amount of passing refrigerant so that the refrigeration cycle is stably continuously performed and, in addition, the refrigeration cycle can be performed in a condition that accomplishes a maximum coefficient of performance.

In addition, in the present embodiment, the refrigerant circuit (20) includes the bypass pipeline (28), thereby making it possible to deliver the high pressure refrigerant after heat dissipation to the heat exchanger (23) or the heat exchanger (24), whichever operates an evaporator, through both the expansion mechanism (60) and the bypass pipeline (28). Therefore, even when the expansion mechanism (60) and the compression mechanism (50) cannot be balanced with each other in the amount of passing refrigerant by refrigerant introduction into the expansion mechanism (60) from the injection pipeline (26), it becomes possible to secure an amount of refrigerant that circulates in the refrigerant circuit (20) by causing the refrigerant to flow through the bypass pipeline (28). In addition, the controller (90) of the present embodiment opens the bypass valve (29) only when the injection valve (27) of the injection pipeline (26) is fully opened. As a result of such arrangement, it becomes possible to suppress the refrigerant flow rate in the bypass pipeline (28) to the minimum necessary, thereby securing the amount of refrigerant that flows through the expansion mechanism (60) to the full, and the degree of reduction in the amount of power recoverable from the refrigerant in the expansion mechanism (60) can be kept to the minimum.

First Variation of the Embodiment

In the controller (90) of the above-described embodiment, the control target value Pd_obj for the high pressure of the refrigeration cycle may be set as follows.

In the setting of the control target value Pd_obj, the controller (90) of the first variation first performs an operation of experimentally increasing or decreasing the high pressure of the refrigeration cycle by shifting either the position of the injection valve (27) or the position of the bypass valve (29). The controller (90) increases or decreases the high pressure of the refrigeration cycle by shifting the position of the injection valve (27), when the bypass valve (29) is being fully closed and only the injection valve (27) is placed in the opened state. On the other hand, the controller (90) increases or decreases the high pressure of the refrigeration cycle by shifting the position of the bypass valve (29), when the injection valve (27) is being fully opened and the bypass valve (29) is also placed in the opened state. The controller (90) makes an actual measure of the COP of the refrigeration cycle when the high pressure of the refrigeration cycle is increased or decreased. The controller (90) derives a correlation between the variation in the high pressure of the refrigeration cycle and the variation in the COP of the refrigeration cycle. Then, the controller (90) uses the derived correlation to find a value of the high pressure of the refrigeration cycle which provides a maximum COP and sets the value as the control target value Pd_obj.

Second Variation of the Embodiment

It may be arranged such that the controller (90) of the above-descried embodiment uses, as a parameter, the temperature of refrigerant discharged out of the compression mechanism (50) (the temperature of discharge refrigerant) to control the position of the injection valve (27) or the position of the bypass valve (29). In other words, it may be arranged such that the controller (90) sets, as a control target value, a discharge refrigerant temperature which provides a maximum COP available in an existing operating condition and controls the position of the injection valve (27) or the position of the bypass valve (29) so that the actually measured value of the discharge refrigerant temperature becomes the control target value. More specifically, Step ST11 of FIG. 8 sets, instead of a control target value for the high pressure of the refrigeration cycle, a control target value of the discharge refrigerant temperature. Subsequently, the controller (90) determines in Step ST12 whether the actually measured value of the discharge refrigerant temperature exceeds the control target value.

Third Variation of the Embodiment

It may be arranged such that the controller (90) of the above-described embodiment uses, as a parameter, the temperature of air after passage through a heat exchanger which is functioning as a heat dissipator to control the position of the injection valve (27) or the position of the bypass valve (29).

The user inputs a set value for the temperature of air after passage through the indoor heat exchanger (24) which becomes a heat dissipator during the heating mode, i.e., the temperature of air discharged out of the indoor unit (13) during the heating mode. And, the controller (90) regulates the high pressure of the refrigeration cycle by controlling the position of the injection valve (27) or the position of the bypass valve (29) so that the actually measured value of the temperature of air after passing through the indoor heat exchanger (24) during the heating mode becomes the target value inputted by the user.

Fourth Variation of the Embodiment

In the above-described embodiment, the high pressure of the refrigeration cycle is measured by the use of the high pressure sensor (95) disposed along the refrigerant circuit (20). Alternatively, it may be arranged such that, instead of making a direct measure of the high pressure of the refrigeration cycle, the high pressure of the refrigeration cycle is estimated from a value detected by another sensor. For example, if the rotation speed of the compression mechanism (50), the electric power consumption of the electric motor (45) which drives the compression mechanism (50), the refrigerant temperature at the heat dissipator exit are measured, this makes it possible to estimate the high pressure of the refrigeration cycle from these measured values.

INDUSTRIAL APPLICABILITY

As has been described above, the present invention finds utility with refrigeration apparatuses having an expander.

What is claimed is:

1. A refrigeration apparatus, comprising:

a refrigerant circuit along which a compressor, a heat dissipator, an expander, and an evaporator are connected, for performing a refrigeration cycle by circulating a refrigerant in the refrigerant circuit;

an injection passageway through which a portion of the refrigerant flowing towards the expander from the heat dissipator in the refrigerant circuit is introduced into an internal communication passageway directly connecting a first expansion chamber of the expander to a second expansion chamber of the expander in the process of expansion; and a flow rate control valve for regulating refrigerant flow rate in the injection passageway, wherein the compressor and the expander are located in a single housing.

2. The refrigeration apparatus of claim 1, comprising:

controller means for adjusting the position of the flow rate control valve so that coefficient of performance of the refrigeration cycle in the refrigerant circuit reaches a maximum value available in a current operating condition of the refrigeration apparatus.

3. The refrigeration apparatus of claim 2, wherein the controller means is configured to derive, based on an actually measured value indicative of an operating condition of the refrigeration apparatus, a high pressure of the refrigeration cycle which maximizes the coefficient of performance of the refrigeration cycle as a control target value and adjust the position of the flow rate control valve so that the derived high pressure of the refrigeration cycle becomes the control target value.

4. The refrigeration apparatus of claim 2, wherein the controller means is configured to derive, based on a variation in the coefficient of performance of the refrigeration cycle occurring when the high pressure of the refrigeration cycle is increased or decreased, a high pressure of the refrigeration cycle which maximizes the coefficient of performance of the refrigeration cycle as a control target value and adjust the position of the flow rate control valve so that the derived high pressure of the refrigeration cycle becomes the control target value.

5. The refrigeration apparatus of claim 1, wherein the refrigerant circuit is charged with carbon dioxide as a refrigerant and the high pressure of the refrigeration cycle performed in the refrigerant circuit is set equal to or above the critical pressure of carbon dioxide.

6. The refrigeration apparatus as recited in claim 1, further comprising:

a supply line connected to the first expansion chamber supplying refrigerant directly into the first expansion chamber.

7. The refrigeration apparatus as recited in claim 1, wherein the first expansion chamber is enclosed by a first piston and a wall of a first cylinder, and the second expansion chamber is enclosed by a second piston and a wall of a second cylinder.

8. The refrigeration apparatus as recited in claim 7, wherein the first piston and the second piston each have an annular shape, the wall of the first cylinder and the wall of the second cylinder are substantially circular, and the first piston and the second piston are configured to rotate eccentrically inside the first cylinder and the second cylinder, respectively.

9. The refrigeration apparatus as recited in claim 7, wherein an outer diameter of the first piston is substantially equal to an outer diameter of the second piston.

10. A refrigeration apparatus, comprising:

a refrigerant circuit along which a compressor, a heat dissipator, an expander, and an evaporator are connected, for performing a refrigeration cycle by circulating a refrigerant in the refrigerant circuit, the refrigerant circuit including a bypass passageway connecting upstream and downstream sides of the expander and a bypass control valve for regulating refrigerant flow rate in the bypass passageway, the compressor and the expander being located in a single housing;

an injection passageway through which a portion of the refrigerant flowing towards the expander from the heat dissipator in the refrigerant circuit is introduced into an internal communication passageway connecting a first expansion chamber to a second expansion chamber of the expander in the process of expansion;

a flow rate control valve for regulating the refrigerant flow rate in the injection passageway; and a controller configured to perform a primary control operation including adjusting position of the flow rate control valve with the bypass control valve held in a fully closed state, the controller being further configured to perform an auxiliary control operation including adjusting position of the bypass control valve with the flow rate control valve held in a fully opened state when the flow rate control valve enters the fully opened state during the primary control operation, and resuming the primary control operation when the bypass control valve enters the fully closed state during the auxiliary control operation.

11. The refrigeration apparatus of claim 10, wherein the controller is configured to derive, based on an actually measured value indicative of an operating condition of the refrigeration apparatus, a high pressure of the refrigeration cycle which maximizes coefficient of performance of the refrigeration cycle as a control target value and perform, as the auxiliary control operation, an operation in which the position of the bypass control valve is adjusted so that the derived high pressure of the refrigeration cycle becomes the control target value.

12. The refrigeration apparatus of claim 10, wherein the controller is configured to derive, based on a variation in coefficient of performance of the refrigeration cycle occurring when the high pressure of the refrigeration cycle is increased or decreased, a high pressure of the refrigeration cycle which maximizes the coefficient of performance of the refrigeration cycle as a control target value and perform, as the auxiliary control operation, an operation in which the position of the bypass control valve is adjusted so that the derived high pressure of the refrigeration cycle becomes the control target value.

13. A method of controlling refrigerant flow in a refrigeration apparatus including a refrigerant circuit along which a compressor, a heat dissipator, an expander, and an evaporator are connected and performing a refrigeration cycle, a bypass passageway connecting upstream and downstream sides of the expander, and an injection passageway supplying a portion of the refrigerant into an internal communication passageway connecting a first expansion chamber to a second expansion chamber of the expander, the method comprising:

determining whether a flow rate valve regulating refrigerant flow rate in the injection passageway is in a fully opened position;

adjusting position of a bypass control valve regulating refrigerant flow rate in the bypass passageway based on said determining;

determining whether the bypass control valve is in a fully closed position; and adjusting position of the flow rate valve based on the determining whether the bypass control valve is in the fully closed position.

* * * * *